US011427442B2

(12) United States Patent
Kashiwakura

(10) Patent No.: US 11,427,442 B2
(45) Date of Patent: Aug. 30, 2022

(54) ANTI-FALLING DEVICE FOR ELEVATOR DOOR

(71) Applicant: FUJITEC CO., LTD., Hikone (JP)

(72) Inventor: Hiroshi Kashiwakura, Hikone (JP)

(73) Assignee: FUJITEC CO., LTD., Hikone (JP)

( * ) Notice: Subject to any disclaimer, the term of this patent is extended or adjusted under 35 U.S.C. 154(b) by 132 days.

(21) Appl. No.: 16/822,568

(22) Filed: Mar. 18, 2020

(65) Prior Publication Data

US 2020/0307957 A1 Oct. 1, 2020

(30) Foreign Application Priority Data

Mar. 25, 2019 (JP) ..... JP2019-056581

(51) Int. Cl.
*B66B 13/08* (2006.01)

(52) U.S. Cl.
CPC ..... *B66B 13/08* (2013.01)

(58) Field of Classification Search
CPC ..... B66B 13/30; B66B 13/08; B66B 13/06
See application file for complete search history.

(56) References Cited

U.S. PATENT DOCUMENTS 5,494,137 A * 2/1996 Kowalczyk ..... B66B 13/08 187/334

FOREIGN PATENT DOCUMENTS

| | | | | |
|---|---|---|---|---|
| CN | 110027973 A | * | 7/2019 | |
| CN | 110054067 A | * | 7/2019 | |
| EP | 1241309 A2 | * | 9/2002 | ..... E05D 15/0647 |
| JP | 5944478 A | | 10/1984 | |
| JP | 08245144 A | * | 9/1996 | |
| WO | WO-2008023435 A1 | * | 2/2008 | ..... B66B 13/08 |

OTHER PUBLICATIONS

English Machine Translation of WO 2008/023435.*
English Machine Translation of EP 1241309.*
Machine Translation of JPH 08-245144.*

* cited by examiner

*Primary Examiner* — Diem M Tran
(74) *Attorney, Agent, or Firm* — The Webb Law Firm

(57) ABSTRACT

An anti-falling device for a door of an elevator of the present invention includes: a door hanger; and a first roller and a second roller both provided on the door hanger and arranged to face a lower end surface of the door rail. The first roller is made of a metal is and arranged at a position downwardly away from the lower end surface of the door rail. The second roller is configured to be in elastic contact with the door rail, and is arranged to be held in contact with the lower end surface or arranged at a position closer to the lower end surface than the first roller.

5 Claims, 4 Drawing Sheets

ANTI-FALLING DEVICE FOR ELEVATOR DOOR

CROSS-REFERENCE TO RELATED APPLICATION

This application claims priority to Japanese Patent Application No. 2019-056581 filed Mar. 25, 2019, the disclosure of which is hereby incorporated by reference in its entirety.

BACKGROUND OF THE INVENTION

Field of the Invention

The present invention relates to an anti-falling device for a door of an elevator configured to prevent the door from falling off a door rail.

Description of Related Art

Conventionally, an elevator is provided with the aforementioned anti-falling device.

For example, an anti-falling device disclosed in JP S59-044478 A is provided with a pair of metal rollers on a lower end side of a door hanger. The pair of rollers are aligned at a distance from each other in a direction in which the door opens and closes, and arranged to be held in contact with a lower end surface of the door rail.

In the elevator provided with the anti-falling device, each door slides while the pair of rollers are held in contact with the lower end surface of the door rail. This configuration prevents an end on a closing direction side of the door (i.e., an end of the door oriented in a direction of the closing operation) from lifting in, for example, opening operation of the door. According to JP S59-044478 A, the elevator provided with the aforementioned anti-falling device can thereby prevent the door from tilting in opening operation of the door.

There are some cases where the aforementioned conventional anti-falling device has the pair of rollers arranged downwardly away from the lower end surface of the door rail to eliminate the contact resistance between the door rail and the pair of rollers. In such cases, a clearance is formed in the vertical direction between the lower end surface of the door rail and each of the pair of rollers. With this configuration, either one of the pair of rollers collides with the lower end surface of the door rail when the door tilts in opening or closing operation. At this time, a problem occurs that abnormal noise is caused by the collision of the metal roller and the metal door rail.

SUMMARY OF THE INVENTION

Technical Problem

In view of such circumstances, it is therefore an object of the present invention to provide an anti-falling device for a door of an elevator capable of reducing occurrence of abnormal noise.

Solution to Problem

An anti-falling device for a door of an elevator of the present invention includes: a door hanger that allows the door for opening and closing a car entrance to be slidably mounted on a door rail; a first roller made of a metal, provided on the door hanger, and arranged to face a lower end surface of the door rail; and a second roller provided on the door hanger, arranged to face the lower end surface of the door rail, and configured to be in elastic contact with the door rail, wherein the first roller is arranged to be away in a vertical direction from the lower end surface of the door rail by a distance, and wherein the second roller is arranged to be held in contact with the lower end surface of the door rail, or arranged to be away in the vertical direction from the lower end surface of the door rail by a distance smaller than the distance by which the first roller is away in the vertical direction from the lower end surface of the door rail.

In the anti-falling device for the door of the elevator of the present invention, the second roller may be arranged between the first roller and a center in an opening and closing direction of the door.

In the anti-falling device for the door of the elevator of the present invention, the configuration may be such that the elevator includes a pair of doors, the pair of doors are configured to slide in a direction toward and away from each other in an opening and closing operations, each of the pair of doors has the door hanger separately, and each of the door hangers provided respectively on the pair of doors have the first roller and the second roller.

The anti-falling device for the door of the elevator of the present invention may include a holding structure configured to press the door to suppress the door from tilting due to lifting up of an end on a closing direction side (i.e., a side oriented in a direction of the closing operation) of the door when the door is closed, wherein the elevator includes a pair of doors, the pair of doors are configured to slide in a direction toward and away from each other in an opening and closing operation, each of the pair of doors has the door hanger separately, the door hanger provided on one door of the pair of doors has the first roller and the second roller, and the door hanger provided on the other door of the pair of doors has the first roller and the holding structure.

In this case, the configuration may be such that the holding structure is constituted by an end retainer configured to prevent the other door from being displaced to an opening direction side (i.e., a side oriented in a direction of the opening operation) opposite to the closing direction side when the door is held closed, and the end retainer is configured to press, diagonally downward in a closing direction (i.e., a direction of the closing operation), a central portion in the opening and closing direction of the door, or a portion on the closing direction side of the door from the central portion.

DESCRIPTION OF THE INVENTION

Hereinafter, an anti-falling device for a door of an elevator according to an embodiment of the present invention (hereinafter referred to as anti-falling device) will be described with reference to the attached drawings. In this embodiment, a description will be given on a door apparatus including the anti-falling device configured to open and close a car entrance.

Figure 1:
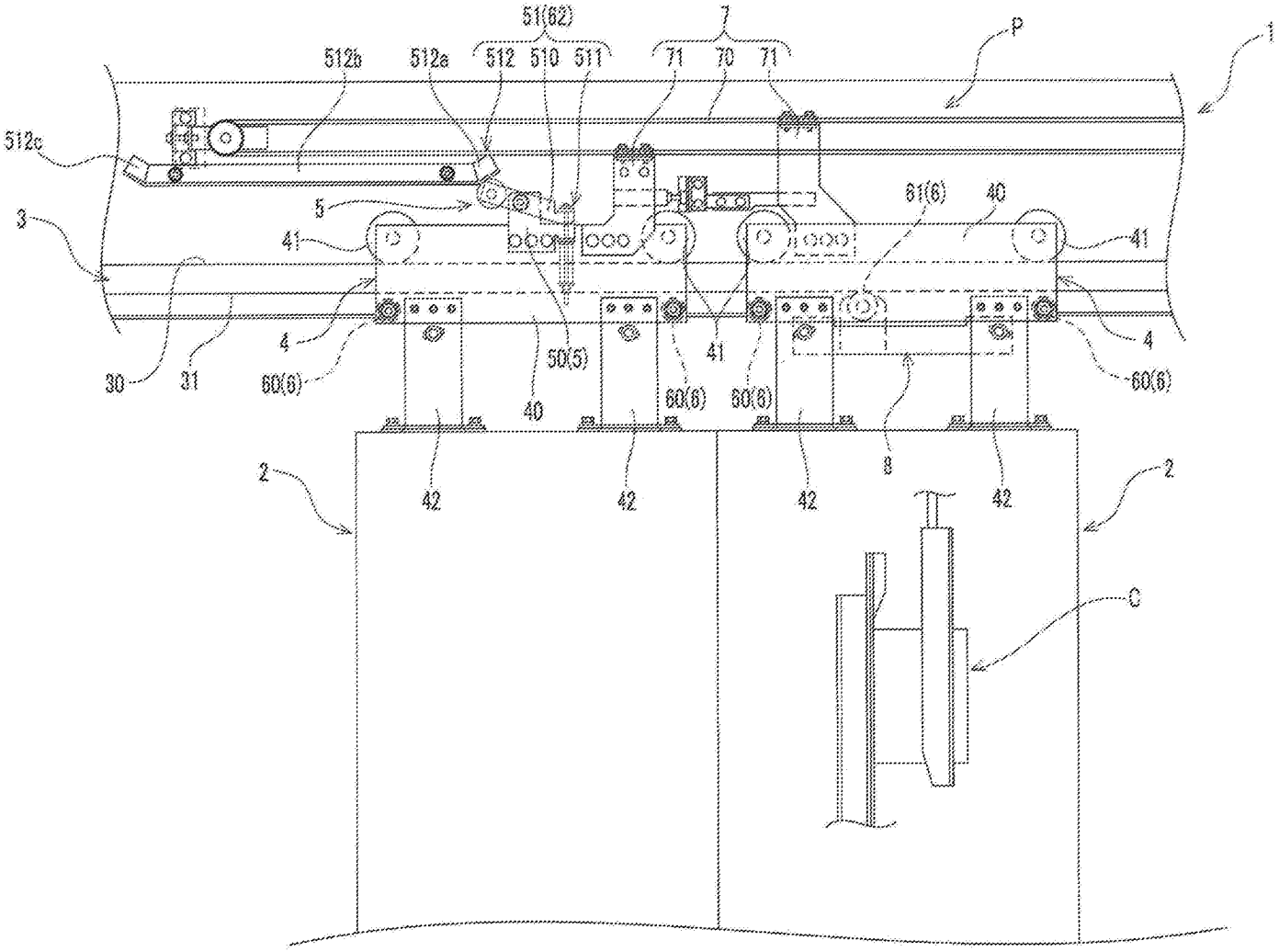
FIG. 1 is a front view of a door apparatus provided with an anti-falling device according to an embodiment of the present invention.

As shown in FIG. 1, a door apparatus includes: a door 2 for opening and closing a car entrance; a door rail 3 arranged above the entrance (more specifically, arranged on a plate P fixed above the entrance) and extending along the horizontal direction; a door hanger 4 mounted to the door 2 and hung on the door rail 3 slidably in the horizontal direction; an end retainer 5 configured to keep the door 2 closed; an anti-falling device 6 that prevents the door 2 from falling off the door rail 3; and a drive mechanism 7 configured to transmit driving force to the door 2 for its opening and closing operation.

The door apparatus according to this embodiment is a so-called center-opening door apparatus. The door apparatus according to this embodiment includes a pair of doors 2, but a door apparatus may include a plurality of pairs of doors 2.

The pair of doors 2 are slidable along the horizontal direction. In this embodiment, one of the pair of doors 2 is provided with a movable cam C.

In this embodiment, a description will be hereinafter given in which a direction corresponding to verticality is referred to as a vertical direction, a direction in which the door 2 slides in its opening and closing operation is referred to as an opening and closing direction, and a direction orthogonal to the vertical direction and the opening and closing direction is referred to as a back and forth direction. Further, a direction in which the door 2 slides in its closing operation is referred to particularly as a closing direction, and a direction in which the door 2 slides in its opening operation is referred to particularly as an opening direction.

The door 2 includes an end on the closing direction side (i.e., an end oriented in a direction of the closing operation), which is hereinafter referred to as closing side end, and an end on the opening direction side (i.e., an end oriented in a direction of the opening operation), which is hereinafter referred to as opening side end.

The door rail 3 is a member for guiding the doors 2 in the opening and closing direction. The door rail 3 is mounted so that its longitudinal direction corresponds to the opening and closing direction.

The door hanger 4 is mounted to each of the pair of doors 2. Each door hanger 4 is arranged above the corresponding door 2 and fixed thereto. The door hanger 4 is configured to be slidable along the door rail 3 while being hung on the door rail 3 (specifically, an upper end surface of the door rail 3). The door 2 can thereby slide along the horizontal direction (i.e., the opening and closing direction).

The door hanger 4 according to this embodiment includes a base 40 arranged above the door 2, a hanger roller 41 mounted to the base 40 and hung on the door rail 3, and a bracket 42 mounted to extend upward from the upper end of the door 2 and having a distal end to which the base 40 is fixed. In this embodiment, each door 2 is provided with two brackets 42 aligned at a distance from each other in the opening and closing direction.

The base 40 has a facing surface arranged to face the door rail 3.

Figure 2:
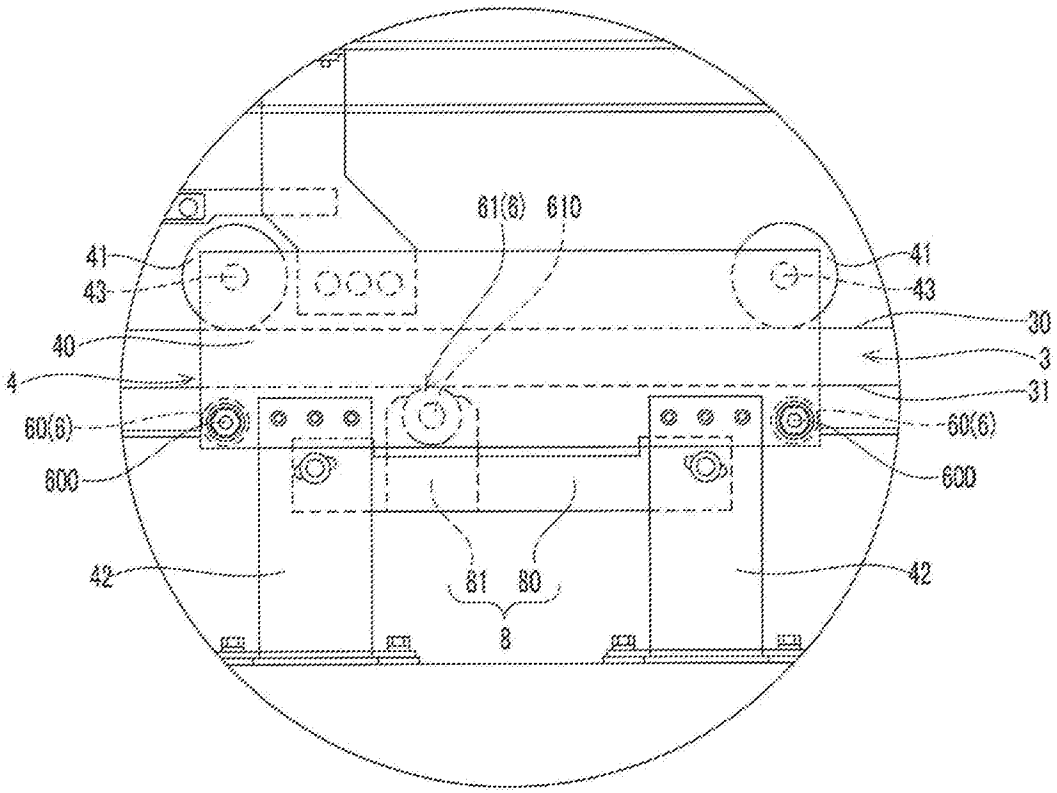
FIG. 2 is an enlarged view of a door hanger provided on one of a pair of doors, and the periphery of the door hanger in FIG. 1.
Figure 3:
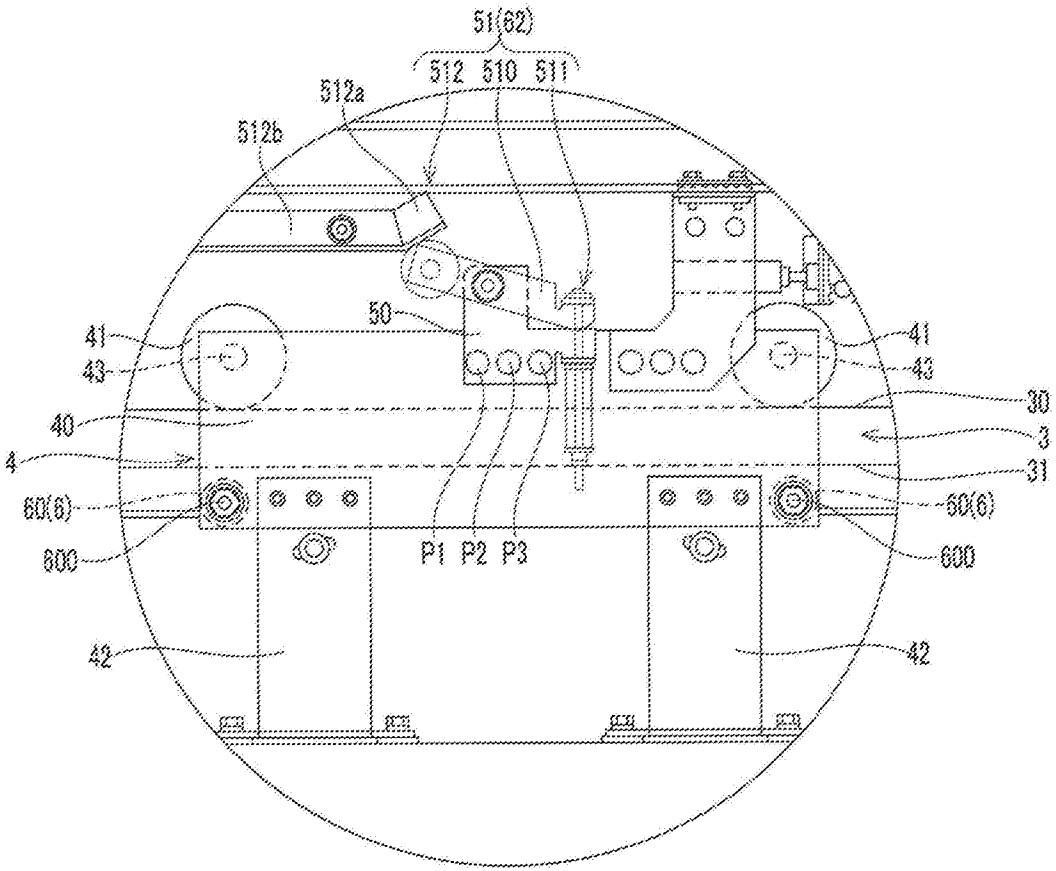
FIG. 3 is an enlarged view of a door hanger provided on the other of the pair of doors, and the periphery of the door hanger in in FIG. 1.

The hanger roller 41 is mounted to the facing surface of the base 40, and rotatable about a hanger roller shaft 43 extending in a direction orthogonal to the facing surface, that is, a direction corresponding to the back and forth direction (see FIG. 2 and FIG. 3).

Each door hanger 4 includes two hanger rollers 41. The two hanger rollers 41 are aligned at a distance from each other in a width direction of the base 40. More specifically, one of the two hanger rollers 41 is mounted to an end portion on the closing direction side of the door hanger 4. The other of the two hanger rollers 41 is mounted to an end portion on the opening direction side of the door hanger 4.

The end retainer 5 is mounted to the other door 2 out of the pair of doors 2. The end retainer 5 is configured to press and hold the other door 2 from above via the door hanger 4.

As shown in FIG. 3, the end retainer 5 includes a frame 50 fixed to an upper portion of the door hanger 4, and a pressing structure 51 for pressing the door 2 to the closing direction side when the door 2 is closed.

The frame 50 is fixed to the door hanger 4 at three fixing positions (i.e., the positions of P1, P2, and P3 shown in FIG. 3). The three fixing positions at which the frame 50 is fixed to the door hanger 4 serve also as the positions at which the end retainer 5 applies a pressing force to the door hanger 4. Out of the three fixing positions at which the frame 50 is fixed to the door hanger 4, two fixing positions are set to be displaced to the closing direction side from the center in the opening and closing direction of the door 2 while the remaining one fixing position is set to be displaced to the opening direction side from the center of the door 2.

The pressing structure 51 includes an elongated lever 510 rotatably mounted to the frame 50 at a portion between both ends in the longitudinal direction of the lever 510, a lever biasing part 511 configured to downwardly bias one end portion in the longitudinal direction of the lever 510, and a pressing member 512 that presses down the other end portion in the longitudinal direction of the lever 510.

The lever 510 is rotatable about a lever shaft extending along the back and forth direction. The one end portion of the lever 510 is located on the closing direction side of the rotation center of the lever 510. The other end portion of the lever 510 is located on the opening direction side of the rotation center of the lever 510.

The lever biasing part 511 is configured to connect the frame 50 and the one end portion of the lever 510. Further, the lever biasing part 511 is configured to downwardly bias the one end portion of the lever 510 at a position displaced to the closing direction side from the center in the opening and closing direction of the door 2.

The pressing member 512 is mounted to the plate P. The pressing member 512 includes: a closing side pressing part 512*a* pressing the other end portion of the lever 510 diagonally downward in the closing direction when the door 2 is closed; an intermediate pressing part 512*b* pressing the other end portion of the lever 510 in opening and closing operation of the door 2; and an opening side pressing part 512*c* pressing the other end portion of the lever 510 diagonally downward in the opening direction when the door 2 is open (see FIG. 1).

The closing side pressing part 512*a* extends to the closing direction side from the intermediate pressing part 512*b*. The closing side pressing part 512*a* is inclined so that its distal end is located at a higher position than its proximal end continuous to the intermediate pressing part 512*b*. Thus, the other end portion of the lever 510 being held in contact with the closing side pressing part 512*a* is pressed diagonally downward in the closing direction by the closing side pressing part 512*a*.

The intermediate pressing part 512*b* extends straight along the opening and closing direction. The other end portion of the lever 510 being held in contact with the intermediate pressing part 512*b* is pressed downward by the intermediate pressing part 512*b*.

The opening side pressing part 512*c* extends to the opening direction side from the intermediate pressing part 512*b*. The opening side pressing part 512*c* is inclined so that its distal end is located at a higher position than its proximal end continuous to the intermediate pressing part 512*b*. Thus, the opening side pressing part 512*c* is configured to press the other end portion of the lever 510 diagonally downward in the opening direction.

In the pressing member 512 according to this embodiment, the closing side pressing part 512*a*, the intermediate pressing part 512*b*, and the opening side pressing part 512*c* are formed integrally with each other. The closing side pressing part 512*a* is continuous to an end in the longitudinal direction (i.e., an end on the closing direction side) of the intermediate pressing part 512*b*, and the opening side pressing part 512*c* is continuous to the other end in the longitudinal direction (i.e., the other end on the opening direction side) of the intermediate pressing part 512*b*.

As shown in FIG. 2 and FIG. 3, the anti-falling device 6 includes: a first roller 60 made of a metal and mounted to the door hanger 4; a second roller 61 mounted to the door hanger 4 and having elasticity; and a holding structure 62 configured to hold the door 2 from above when the door 2 is closed (see FIG. 3). As also shown in FIG. 2, the second roller 61 is arranged between the pair of first rollers 60 in an opening and closing direction of the door 2.

The first roller 60 and the second roller 61 are arranged on the facing surface of the door hanger 4. The first roller 60 and the second roller 61 are rotatable respectively about rotating shafts 600 and 610 both extending along a direction orthogonal to the facing surface of the door hanger 4 (that is, a direction corresponding to the back and forth direction).

As shown in FIG. 2, the door apparatus 1 according to this embodiment includes a mounting structure 8 for mounting the second roller 61 thereto. The mounting structure 8 includes a first mounting part 80 extending between the pair of brackets 42 (i.e., the pair of brackets mounted to the one door 2); and a second mounting part 81 extending from the first mounting part 80 to the position higher than the lower end of the base 40.

The second mounting part 81 is arranged at a position displaced in the back and forth direction on the door rail 3 side from the facing surface of the base 40, and has a leading end to which the second roller 61 is mounted.

The first mounting part 80 and the second mounting part 81 may each be formed of a metal panel. The first mounting part 80 and the second mounting part 81 can have flexibility by being formed thinly (for example, formed to have a thickness of about 2 mm). This configuration enables the first mounting part 80 and the second mounting part 81 to be deformed to allow the second roller 61 to be in elastic contact with the door rail 3 and thereby absorb (relieve) the force transmitted from the door 2 to the second roller 61. In the case where the first mounting part 80 and the second mounting part 81 are configured to be capable of absorbing the force transmitted to the second roller 61, the second roller 61 may be made of a metal.

As shown in FIG. 2 and FIG. 3, the first roller 60 and the second roller 61 are mounted at positions displaced downward from the hanger roller 41 (i.e., positions displaced on the lower end side of the door hanger 4) to thereby form a space in the vertical direction for arranging the door rail 3 between the hanger roller 41, and the first roller 60 and the second roller 61.

Thus, the hanger roller 41 is configured to face (be held in contact with) a top surface of the door rail 3 in the vertical direction, and the first roller 60 and the second roller 61 are configured to face (be held in contact with) a bottom surface of the door rail 3 in the vertical direction.

The second roller 61 may be made of, for example, a rubber or a urethane. The second roller 61 is preferably provided with a bearing. This configuration can suppress the increase in the torque required for the opening and closing operation of the door 2, even if the second roller 61 is held in contact with the lower end surface of the door rail 3 when the door 2 opens and closes.

As shown in FIG. 1, the drive mechanism 7 includes: a motor (not shown); a belt 70 formed into an annular shape and configured to rotate by the driving force of the motor; and a connector 71 through which the door hanger 4 is connected to the belt 70.

The connector 71 is formed to connect an end portion on the closing direction side of the door hanger 4 to the belt 70.

The configurations of the door apparatus provided with the anti-falling device 6 according to this embodiment have been described as above. When the closing door 2 swings in association with its acceleration or tilts (lifts) due to its collision with an obstruction, a push-up force is generated so that the door 2 pushes other members upward (i.e., to the door rail 3 side). The first roller 60 and the second roller 61 are pushed up to the door rail 3 side by the push-up force.

In the anti-falling device 6 of this embodiment, the second roller 61 is held in contact with the door rail 3, and thus reduces the swing of the door 2 that is being accelerated. This configuration prevents the door 2 from moving with the first roller 60 being in sliding contact with the door rail 3, and thereby prevents abnormal noise from being constantly generated in association with the swing of the door 2.

In the case where the second roller 61 is provided with a bearing, the resistance force generated due to the acceleration of the door 2 in the opening and closing operation (i.e., the resistance force generated between the lower end surface of the door rail 3 and the second roller 61) is reduced, and thus an increase in the torque required for opening and closing the door 2 can be suppressed.

Further, in the case where the second roller 61 constantly is held in contact with the lower end surface of the door rail 3 while causing no pressing force to act thereon or causing substantially no pressing force to act thereon, the increase in the torque for opening and closing the door 2 is further suppressed depending on the contacting state between the second roller 61 and the lower end surface of the door rail 3.

In the case where the door 2 collides with an obstruction and thereby tilts, the push-up force is absorbed (relieved) by elastic deformation of the second roller 61 (i.e., elastic deformation of the second roller 61 caused by being pressed against the door rail 3) to thereby prevent the first roller 60 from contacting the door rail 3 or to reduce the impact caused when the first roller 60 contacts the door rail 3. Thus, in the case where the door 2 collides with an obstruction, abnormal noise instantaneously generated by collision of the first roller 60 with the door rail 3 can be prevented or reduced.

If the first roller 60 is configured to be brought into contact with the door rail 3 after the second roller 61 contacts the door rail 3 but before the second roller 61 reaches its elastic limit, the first roller 60 can also receive the push-up force while the second roller 61 absorbs (relieves) the push-up force within a range where the second roller 61 can be elastically deformed. This configuration can prevent the second roller 61 from being damaged.

Such a configuration if employed suppresses the push-up force received by the first mounting part 80 and the second mounting part 82, and thus prevents the first mounting part 80 and the second mounting part 81 even if formed thinly from being subjected to damages such as permanent deformation or fatigue failure.

As described above, the anti-falling device 6 according to this embodiment can produce an excellent effect of reducing occurrence of abnormal noise by suppressing the collision of the metal first roller 60 with the door rail 3.

The second roller 61 is arranged at a position displaced to the closing direction side from the center in the opening and closing direction of the door 2, and thereby suppresses the collision of the first roller 60 with the door rail 3 particularly at the time of opening the door 2. This configuration can reduce occurrence of abnormal noise.

In the case where the door 2 that is being accelerated for closing collides with an obstruction, the door 2 tilts so that the opening side end lifts upward relative to the closing side end. However, the second roller 61 is arranged between the center in the opening and closing direction of the door 2 and the first roller 60 mounted at a position on the closing direction side, and is thus unlikely to be subjected to a force of the door 2 pushing other members to the door rail 3 side (push-up force). This configuration allows the second roller 61 to be less likely to be damaged.

In the case where the closing side end of the door 2 lifts due to the reaction when the opening side end lowers after it once lifts, the push-up force decreases and thus the second roller 61 is not subjected to a large push-up force.

The other door 2 when the car entrance is held closed has the closing side end pressed and held by the pressing structure 51 (holding structure 62) from above, and is thus suppressed from tilting (lifting) when the other door 2 begins opening. Thus, the other door 2 is also configured to allow the first roller 60 to hardly come close to the lower end surface of the door rail 3, and configured to be thereby capable of suppressing the first roller 60 from colliding with the lower end surface of the door rail 3.

In this embodiment, the pressing structure 51 is constituted by the end retainer 5; thus, the end retainer 5 configured to keep the door 2 closed can be used as the holding structure 61 for suppressing the other door 2 from tilting.

Further, the end retainer 5 is configured to press the door 2 only downward when the door 2 is in opening and closing operation, and thus does not disturb opening and closing operations of the door 2 through the pressing force.

It is a matter of course that the anti-falling device of the present invention is not limited to the aforementioned embodiment, but various modifications can be made without departing from the gist of the present invention.

The aforementioned embodiment has been described by taking, for example, the case where the second roller 61 is arranged to be held in contact with the lower end surface of the door rail 3, without limitation thereto. For example, the second roller 61 may be arranged to be away in the vertical direction from the lower end surface of the door rail 3 by a distance and arranged to have such a distance smaller than the distance by which the first roller 60 is away in the vertical direction from the lower end surface of the door rail 3.

The aforementioned embodiment has been described by taking, for example, the case where the end retainer 5 applies the pressing force to the door hanger 4 at a position displaced to the closing direction side from the center in the opening and closing direction of the door 2, without limitation thereto. For example, the end retainer 5 may be configured to apply the pressing force to the door hanger 4 at a position corresponding to the center in the opening and closing direction of the door 2 and at a position displaced to the closing direction side from the center, or to apply the pressing force to the door hanger 4 only at the position corresponding to the center in the opening and closing direction of the door 2.

As described above, in the case where the end retainer 5 is used as the holding structure 62, the end retainer 5 may be configured to apply the pressing force to the door hanger 4 at least one of the center in the opening and closing direction of the door 2 and a position displaced to the closing direction side from the center. In this case, the end retainer 5 does not have to be configured to apply the pressing force to the door hanger 4 at a position displaced to the opening direction side from the center in the opening and closing direction of the door 2.

The aforementioned embodiment has been described by taking, for example, the case where two fixing positions at which the end retainer 5 is fixed to the door hanger 4 are set in an area on the closing direction side with reference to and including the center in the opening and closing direction of the door 2, without limitation thereto. For example, at least one fixing position at which the end retainer 5 is fixed to the door hanger 4 may be set in the area. Since the pressing force of the end retainer 5 is transmitted to the door hanger 4 at a fixing position, the end retainer 5 is capable of holding a portion on the closing direction side of the door hanger 4 from above as long as at least one fixing position is set in the area.

In the doors of this embodiment, the door hanger 4 mounted to the one door 2 out of the pair of doors 2 has the first roller 60 and the second roller 61 while the door hanger 4 mounted to the other door 2 out of the pair of doors 2 has only the first roller 60 out of the first roller 60 and the second roller 61.

The aforementioned embodiment has been described by taking, for example, the case where the door hanger 4 mounted to the other door 2 out of the pair of doors 2 has only the first roller 60 out of the first roller 60 and the second roller 61, without limitation thereto. For example, each door hanger 4 may have the first roller 60 and the second roller 61. In the case where the second roller 61 is mounted to the door hanger 4 fixed to the other door 2, the anti-falling device 6 does not have to include the holding structure 62.

Figure 4:
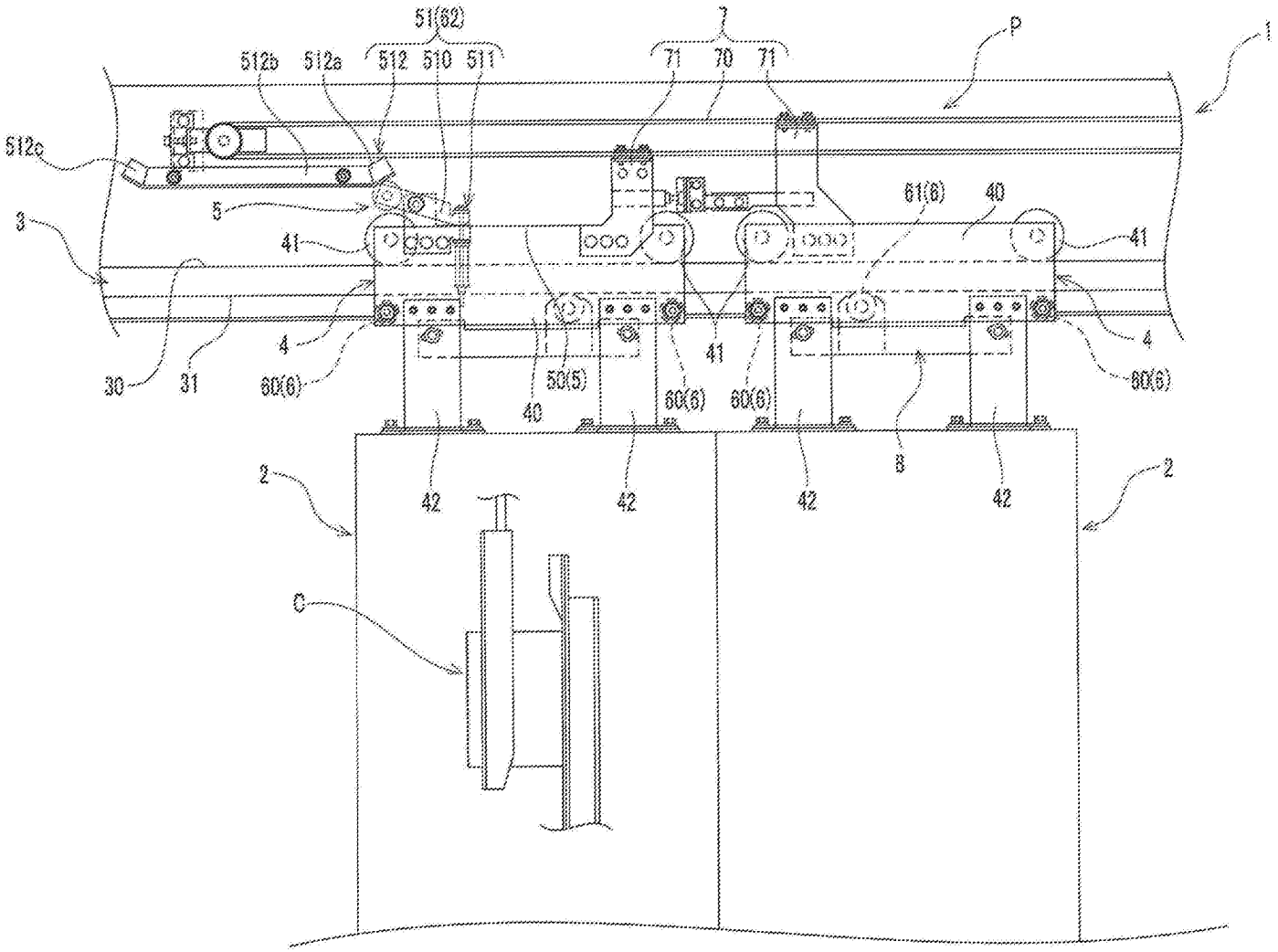
FIG. 4 is a front view of a door apparatus provided with an anti-falling device according to another embodiment of the present invention.

In this case, as shown in, for example, FIG. 4, when the other door 2 is provided with the movable cam C, the end retainer 5 is arranged at a position displaced to the opening direction side from the movable cam C, and accordingly presses a position of the door hanger 4 displaced to the opening direction side from the center in the opening and closing direction of the door 2. This configuration still allows the second roller 61 to suppress the first roller 60 from colliding with the door rail 3.

In the case where the other door 2 is provided with the movable cam C, for example the pressing structure 51 and the end retainer 5 may be configured independently of each other. Even in the case where the other door 2 is not provided with the movable cam C, it is still possible to configure the holding structure 62 and the end retainer 5 independently of each other.

As described above, even the so-called center-opening door 2 can be configured to suppress the first roller 60 from colliding with the door rail 3 when the door 2 is opening.

The aforementioned embodiment has been described by taking, for example, the case where the base 40 is fixed to the upper end of the door 2 via the brackets 42, without limitation thereto. For example, the base 40 may be directly fixed to the upper end of the door 2. That is, the base 40 may be directly or indirectly fixed to the upper end of the door 2.

Although not particularly mentioned, the door 2 in the aforementioned embodiment is more likely to be subjected to the force of pressing and holding a portion on the closing direction side of the door 2 in the case where the closing side pressing part 512*a* is arranged at a position displaced to the closing direction side from the center in the opening and closing direction of the door 2. This configuration allows the first roller 60 to hardly come close to the door rail 3.

REFERENCE NUMBER LIST

1: Elevator
2: Door
3: Door rail
4: Door hanger
5: End retainer
6: Anti-falling device
7: Drive mechanism
40: Base
41: Hanger roller
42: Bracket
43: Hanger roller shaft
50: Frame
51: Pressing structure
60: First roller
61: Second roller
62: Holding structure
70: Belt
71: Connector
510: Lever
511: Lever biasing part
512: Pressing member
512*a*: Closing side pressing part
512*b*: Intermediate pressing part
512*c*: Opening side pressing part
600, 610: Rotating shaft
C: Movable cam

What is claimed is:

1. An anti-falling device for a door of an elevator, comprising:

a door hanger that allows the door for opening and closing a car entrance to be slidably mounted on a door rail;

a hanger roller provided on the door hanger and arranged to face an upper end surface of the door rail;

a pair of first rollers each made of a metal, provided on the door hanger, and arranged to face a lower end surface of the door rail; and a second roller provided on the door hanger, arranged to face the lower end surface of the door rail, and configured to be in elastic contact with the door rail, wherein the second roller is arranged between the pair of first rollers in an opening and closing direction of the door, wherein each of the pair of first rollers is arranged to be away in a vertical direction from the lower end surface of the door rail by a distance, and wherein the second roller is arranged to be held in contact with the lower end surface of the door rail, or arranged to be away in the vertical direction from the lower end surface of the door rail by a distance smaller than the distance by which each of the pair of first rollers is away in the vertical direction from the lower end surface of the door rail.

2. The anti-falling device for a door of an elevator according to claim 1, wherein the second roller is arranged between one of the pair of first rollers and a center in the opening and closing direction of the door.

3. The anti-falling device for a door of an elevator according to claim 1, wherein the elevator comprises a pair of doors, the pair of doors is configured to slide in a direction toward and away from each other in an opening and closing operation, each of the pair of doors has the door hanger separately, and each of the door hangers provided respectively on the pair of doors has the pair of first rollers and the second roller.

4. The anti-falling device for a door of an elevator according to claim 1, further comprising a holding structure configured to press the door to suppress the door from tilting due to lifting up of an end on a closing direction side of the door when the door is closed, wherein the elevator comprises a pair of doors, the pair of doors is configured to slide in a direction toward and away from each other in an opening and closing operation, each of the pair of doors has the door hanger separately, the door hanger provided on one door of the pair of doors has the pair of first rollers and the second roller, and the door hanger provided on the other door of the pair of doors has the pair of first rollers and the holding structure.

5. The anti-falling device for a door of an elevator according to claim 4, wherein the holding structure is constituted by an end retainer configured to prevent the other door from being displaced to an opening direction side opposite to the closing direction side when the door is held closed, and the end retainer is configured to press, diagonally downward in a closing direction, a central portion in the opening and closing direction of the door, or a portion on the closing direction side of the door from the central portion.

* * * * *